US005184636A

United States Patent [19]

van der Woude

[11] Patent Number: 5,184,636

[45] Date of Patent: Feb. 9, 1993

[54] CLEANING LANCE DEVICE FOR CLEANING PIPE BUNDLES OF HEAT EXCHANGERS

[76] Inventor: Meino Jan van der Woude, No. 2, Oude Slingeweg, NL-9204 WS Drachten, Netherlands

[21] Appl. No.: 749,902

[22] Filed: Aug. 26, 1991

[30] Foreign Application Priority Data

Aug. 31, 1990 [NL] Netherlands ..... 9001926

[51] Int. Cl.[5] ..... B08B 3/02

[52] U.S. Cl. ..... 134/167 C; 134/172; 134/198; 122/379

[58] Field of Search ..... 15/104.31, 317; 134/166 R, 166 C, 167 R, 167 C, 172, 181, 198; 122/391, 379

[56] References Cited

U.S. PATENT DOCUMENTS

| | | | |
|---|---|---|---|
| 2,595,655 | 5/1952 | Hannay | 15/315 X |
| 2,742,242 | 4/1956 | Goodwin | 15/315 X |
| 3,866,679 | 2/1975 | Laky | 134/167 C |
| 4,042,305 | 8/1977 | Vincent | 15/104.33 |
| 5,002,120 | 3/1991 | Boisture et al. | 134/166 C |

FOREIGN PATENT DOCUMENTS

| | | | |
|---|---|---|---|
| 2219847 | 10/1973 | Fed. Rep. of Germany | 134/167 C |
| 3238602 | 4/1984 | Fed. Rep. of Germany | 134/167 C |
| 321603 | 1/1972 | U.S.S.R. | 134/167 C |

*Primary Examiner*—Frankie L. Stinson
*Attorney, Agent, or Firm*—Mark Zovko

[57] ABSTRACT

Cleaning lance device for cleaning pipe bundles of heat exchangers comprising a frame, an elongate guiding carried by the frame, a hose drum rotatably mounted on the frame close to a rear end of the guiding, a high pressure hose which is connected at one end to the hose drum and which carries at its other end a coupling element co-acting with the guiding and movable therealong, a bundle of spray lances which are connected to the coupling element in the line of the hose and which carry spray heads at their free end, and drive means for driving the hose drum in the unwinding and winding sense, for unwinding the hose from the hose drum and winding it thereon respectively and for driving the coupling element synchronously therewith along the guiding at least during unwinding, such that therein the portion of the hose extending between the coupling element and the hose drum is substatially free of tensile and pressure loads in lengthwise direction.

6 Claims, 2 Drawing Sheets

CLEANING LANCE DEVICE FOR CLEANING PIPE BUNDLES OF HEAT EXCHANGERS

The invention relates to a cleaning lance device for cleaning pipe bundles of heat exchangers.

In a per se known cleaning lance device for cleaning pipe bundles of heat exchangers a number of lances provided with spray heads are each pushed through a pipe of the pipe bundle, wherein cleaning water comes out at high pressure through the spray head. Deposits in the pipes of the pipe bundle are hereby removed.

When the spray heads of the lances have been pushed through the pipes along the entire length, the lances are withdrawn and placed again into a number of other pipes of the pipe bundle in order to also clean these. All the pipes of the pipe bundle are thus successively cleaned. The cleaning water is supplied under high pressure via a high pressure hose connected to the end of the spray lances opposite the spray heads. This high pressure hose is wound onto a drum and the hose is unrolled and rolled up by reciprocal driving of this drum, wherein the lances move reciprocally as a result of a suitable guiding. The lances are therefore pushed forward when the hose is unrolled so that a pushing force occurs in the hose acting in its lengthwise direction. It has been found that repeatedly unwinding and rewinding the high pressure hose in the manner described results in serious problems. In the known art the life-span of the hose is limited.

The invention has for its object to obviate this drawback.

The cleaning lance device according to the invention comprises a frame, an elongate guiding carried by the frame, a hose drum rotatably mounted to the frame close to a rear end of the guiding, a high pressure hose which is connected at one end to the hose drum and which carries at its other end a coupling element coacting with the guiding and movable therealong, a bundle of spray lances which are connected to the coupling element in the line of the hose and which carry spray heads at their free end, and drive means for driving the hose drum in the unwinding and winding sense, for unwinding the hose from the hose drum and winding it thereon respectively and for driving the coupling element synchronously therewith along the guiding at least during unwinding, such that therein the portion of the hose extending between the coupling element and the hose drum is substantially free of tensile and pressure loads in lengthwise direction. The hose hereby no longer has to be dimensioned for absorbing the pressure forces when the lances are extended. Stiffness of the hose itself in lengthwise direction is thus superfluous so that a hose can be employed that is flexible and allows of good winding onto and unwinding from the drum. The coupling element does not need to be driven when the hose is rolled up since the tensile forces occurring during winding up in normal operation are relatively small and just sufficient to ensure that the hose comes to lie properly on the drum. Because the stiffness of the hose is no longer a decisive factor for the good functioning of the device, a hose can now be selected which meets high requirements with respect to pressure resistance so that the safety of the device satisfies high requirements.

A favourable further development of the device according to the invention is characterized in claim 2. Thus ensured is that the hose lies on the drum in a precisely determined manner so that unfavourable loads due to the incorrect lie of the hose are avoided.

Further favourable developments are characterized in claims 3 and 4.

In the operational situation the diameter of the hose increases slightly as a result of the high pressure of the cleaning water which can amount to many hundreds of bar. The high pressure is switched on at the beginning of the outward stroke, or at the start of unrolling of the hose from the drum. Owing to the slight diameter enlargement the hose grips into the groove of the drum so that this unrolls under accurately reproducible conditions. Although this has not been established with certainty, it is probable that due to the (very slight) swelling of the hose and the support in the grooves, a tensile stress occurs in lengthwise direction in the rolled up hose which provides a clamping on the drum periphery such that the hose remains lying accurately on the drum.

A very favourable embodiment of the device according to the invention is characterized in claim 5. By making use of only one drive motor which drives the hose drum and the winching drum with the indicated transmissions, a rigorously synchronous operation of the two parts of the drive is achieved. The necessary power for driving the drum and that for driving the coupling element is automatically divided between both parts in the correct ratio. In the case of a large counter pressure from the lances a significant part of the power of the drive motor will be transferred onto the coupling element, while for instance when the high pressure pump is not switched on, precisely as much power is supplied to each of the hose drum and the coupling element as is necessary to overcome the friction. When the hose is wound in the winch cable unwinds and the winding drum therefore requires no power. All the available drive power is supplied to the hose drum so that retraction of the spray lances can take place at a relatively high speed.

The invention will be elucidated further in the following description with reference to the annexed drawings of a preferred embodiment of the invention.

Figure 1:
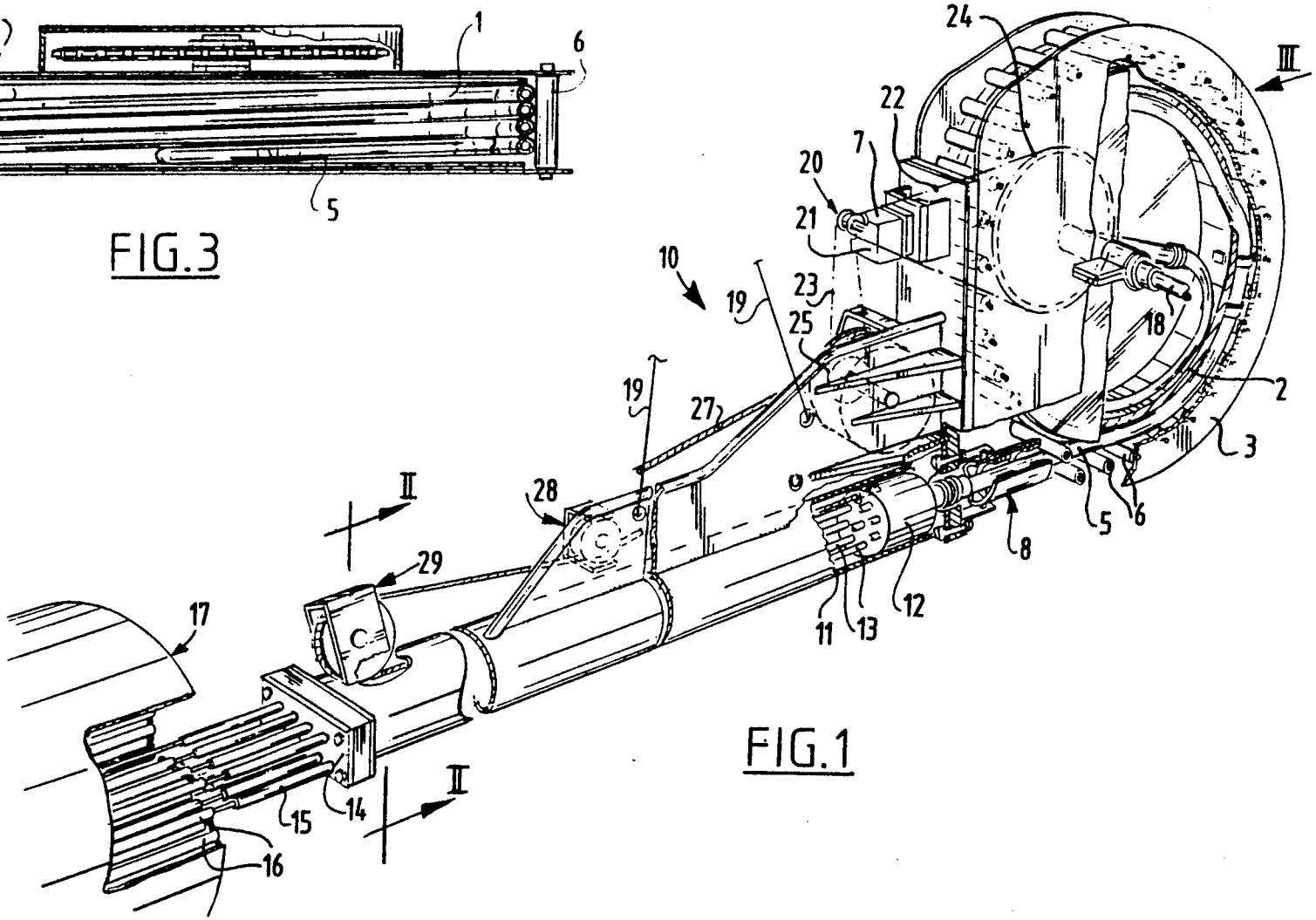
FIG. 1 shows a partially broken away perspective view of the device.

The device generally designated with the reference numeral 10 in FIG. 1 is a preferred embodiment of the invention and comprises a frame 11 that is substantially formed by an elongate tube which forms a guiding for a coupling element 12 to be further described.

Figure 3:
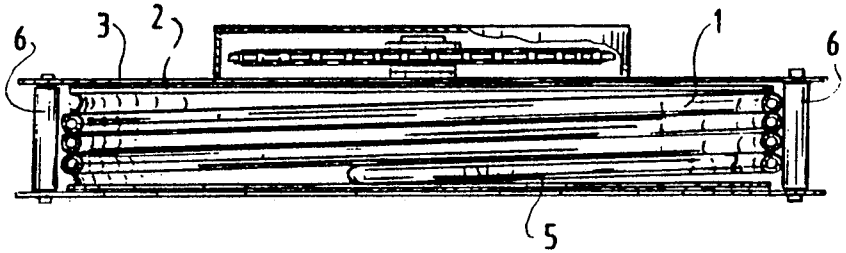
FIG. 3 shows a view according to arrow III in FIG. 1, wherein the hose is shown in section according to a diametral plane of the drum.
Figure 2:
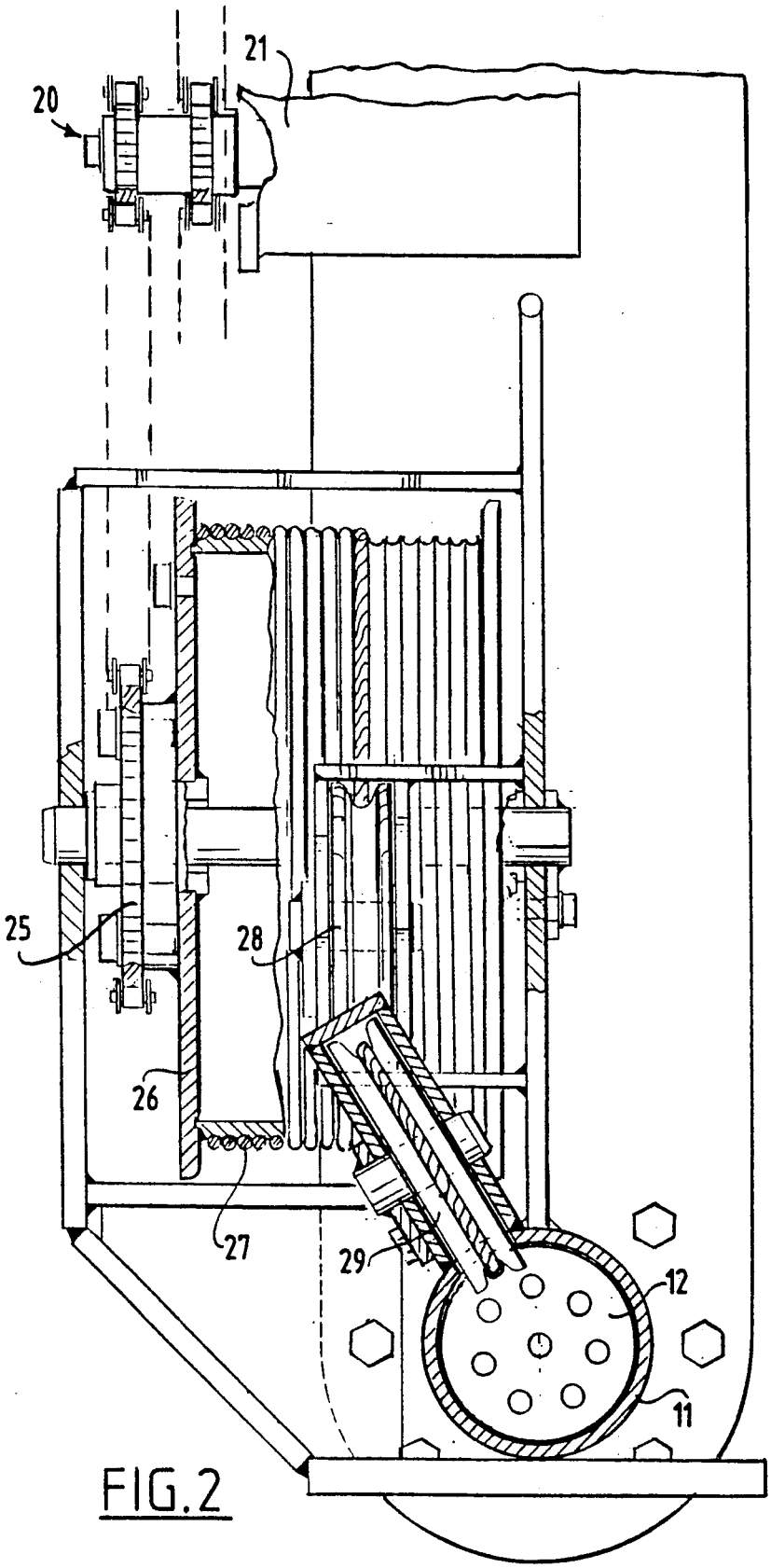
FIG. 2 shows a section according to arrow II—II in FIG. 1.

Against the right-hand end of the frame 11 in FIG. 1 a hose drum 2 is rotatably mounted between frame plates 3. As shown in particular in FIG. 3, the drum 2 is provided on its outer periphery with a helically extending groove 1 which has a part-circular profile with a diameter substantially equal to the diameter of the high pressure hose 5. The high pressure hose 5 is connected fixedly with one end to the drum close to the central shaft thereof. Cleaning liquid under high pressure is supplied into the hose through this shaft via a connection 18 with a high pressure pump.

The other, free end of the high pressure hose 5 is connected to the above mentioned coupling element 12. Where the high pressure hose 5 leaves the drum a hose guide 8 is arranged, in this embodiment pivotally about a vertical axis.

A bundle of spray lances 13 is connected to the coupling element 12 in the line of the hose 5. On the end of the frame 11 remote from the drum is mounted a guide block 14 in which is received a sleeve 15 for each spray lance 13. The sleeves 15 of the guide block 14 are ordered in accordance with the pipes 16 for cleaning, the so-called pitch in a heat exchanger 17. The guide block 14 is exchangeable so that the positioning of the ends of the spray lances 13 can be adapted to a heat exchanger for cleaning.

For cleaning the pipes 16 of the heat exchanger 17 the device is hung at the correct position for the pipes 16 of the heat exchanger 17 using a hoisting crane on which the device is suspended using the balance beam 19. The ends of the spray lances 13 which are provided with spray heads (not shown) are inserted into the pipes 16. After the high pressure pump is switched on, the bundle of spray lances 13 are then moved to the left as seen in FIG. 1 by drive means to be described hereinafter, wherein the spray heads are thus moved forward through the pipes 16. Deposits in the pipes 16 are released and washed away with the cleaning water coming out of the nozzles under high pressure. At the end of the stroke when the coupling piece 12 has moved close to the guide block 14, the high pressure pump is switched off and the spray lances are moved back again wherein the high pressure hose 5 is wound onto the drum 2. After the spray lances 13 have been re-positioned for a following series of pipes 16 the operation is repeated until all the pipes 16 of the heat exchanger 17 have been treated.

The drive means generally designated by 20 consist of two parts. The first part provides the driving of the hose drum 2 in unwinding and winding sense for respectively unwinding the hose from and winding it onto the hose drum, and a second part for driving the coupling piece 12 synchronously with the movement of the hose 5 obtained by the first part of the drive means. That is, when the hose drum 2 is driven in the unwinding sense the coupling piece 12 is simultaneously driven to the left as seen in FIG. 1, such that the portion of the hose 5 extending between the coupling element 12 and the hose drum 2 is substantially free of tensile and pressure loads in lengthwise direction.

The drive means 20 according to the embodiment shown comprise one drive motor for both the mentioned parts. This drive motor 21 is preferably a hydraulic motor.

Two pinions are mounted to the output shaft of this drive motor 21. The first forms part of a first drive gear 22 for driving the drum 2. This drive gear further comprises a chain wheel 24 fixedly coupled to the drum 2 and a chain which is arranged over this chain wheel 24 and the relevant pinion on the shaft of the motor 21. The second drive gear 23 drives a drum 26 of a winch. As can be seen in the figures, the winch drum 26 co-acts with a winch cable 27 which runs from the winch drum 26 via a first guide pulley 28 and a second guide and reverse pulley 29 close to the guide block 14 to the coupling element 12 and is connected thereto.

This second drive gear for the winch drum 26 comprises in a manner similar to the first drive gear 22 a chain wheel 25 coupled to the winch drum 26 and a chain arranged over this chain wheel 25 and the associated pinion on the output shaft of the motor 21.

The transmission ratios of the first drive gear and the second drive gear are selected such that the above described synchronous action is obtained. For this purpose the transmission ratio of the first drive gear is in the same relation to that of the second drive gear as the diameter of the winch drum 26 to the diameter of the hose drum 2. It is thus hereby achieved that the effective peripheral speed of the winch drum is equal to the effective peripheral speed of the hose drum.

To apply the invention it is not necessary for use to be made of a single drive motor. The hose drum and the winch drum can be driven for example by hydrostatic motors connected in series with the correct ratio between rotation speed and volume flow. The coupling element 12 could also be driven by a hydraulic cylinder instead of a winch. A winch drum of the same diameter could also be coupled fixedly to the hose drum.

The advantage of the use of one drive motor 21 with separate drive gears lies in the convenient arrangement and reliability of the construction. As described above, the power delivered by the drive motor is divided over both parts of the driving in accordance with the power required so that efficient energy management is possible and for example the winding up of the hose during the return stroke can take place at maximum speed.

As the figures also clearly show, a number of pressure rollers 6, in the embodiment shown 32, are arranged uniformly distributed over the periphery of the drum 2. These rollers 6 are rotatably mounted between the frame plates 3. The rollers 6 lie at such a diameter that at least in the pressure free situation of the high pressure hose 5 the hose rolled up on the drum 2 runs just clear of the rollers 6. The rollers 6 can for example be of nylon.

I claim:

1. Cleaning lance device for cleaning pipe bundles of heat exchangers comprising a frame, an elongate guiding carried by the frame, a hose drum rotatably mounted on the frame close to a rear end of the guiding, a high pressure hose which is connected at one end to the hose drum and which carries at its other end a coupling element co-acting with the guiding and movable therealong, a bundle of spray lances which are connected to the coupling element in the line of the hose and which carry spray heads at their free end, and drive means for driving the hose drum in the unwinding and winding sense, for unwinding the hose from the hose drum and winding it thereon respectively and for driving the coupling element synchronously therewith along the guiding at least during unwinding, such that therein the portion of the hose extending between the coupling element and the hose drum is substantially free of tensile and pressure loads in lengthwise direction.

2. Device as claimed in claim 1, wherein a helically extending groove is formed in the surface of the drum, which groove has a part-circular section with a diameter which substantially corresponds with the diameter of the hose.

3. Device as claimed in claim 2, wherein the end of the stiff hose connected to the hose drum is coupled to a high pressure pumping device and wherein the diameter of the part-circular section of the groove in the drum surface substantially corresponds with the diameter of the hose in the situation in which this is not under pressure from the high pressure pump.

4. Device as claimed in claim 3, wherein guide rollers are arranged along almost the entire periphery of the drum which extend parallel to the drum surface and lie at a distance from the drum surface such that in the pressure-free situation of the hose these rollers just do not touch the hose.

5. Device as claimed in claim 1, wherein the drive means for the coupling element comprise a winch with a winch drum mounted on the frame and a winch cable which is connected to the coupling element and which can exert a tensile force on the coupling element in the direction away from the hose drum, and the drive means further comprise a drive motor coupled to the hose drum by a drive gear with a first transmission ratio and to the winch drum by a drive gear with a second transmission ratio, wherein the first and the second transmission ratios are in the same proportion as the diameters of the winch drum and the hose drum.

6. Device as claimed in claim 5, wherein the drive gears are chain drives.

* * * * *